US008841824B2

(12) United States Patent
Ko et al.

(10) Patent No.: US 8,841,824 B2
(45) Date of Patent: Sep. 23, 2014

(54) BROADBAND LIGHT ILLUMINATORS

(71) Applicant: Samsung Electronics Co., Ltd., Suwon-si (KR)

(72) Inventors: Woo-Seok Ko, Seoul (KR); Yu-Sin Yang, Seoul (KR); Sue-Jin Cho, Yongin-si (KR); Won-Don Joo, Incheon (KR); Min-Kook Kim, Goyang-si (KR); Sang-Kil Lee, Yongin-si (KR); Byeong-Hwan Jeon, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 13/667,203

(22) Filed: Nov. 2, 2012

(65) Prior Publication Data

US 2013/0169140 A1 Jul. 4, 2013

(30) Foreign Application Priority Data

Dec. 29, 2011 (KR) ..... 10-2011-0145437

(51) Int. Cl.

| | |
|---|---|
| ***H01J 5/16*** | (2006.01) |
| ***H01J 61/40*** | (2006.01) |
| ***H01K 1/26*** | (2006.01) |
| ***H01K 1/30*** | (2006.01) |

(52) U.S. Cl.
USPC ..... 313/111; 250/306; 356/237.1

(58) Field of Classification Search
USPC ..... 313/111, 153–162
See application file for complete search history.

(56) References Cited

U.S. PATENT DOCUMENTS

| | | | | |
|---|---|---|---|---|
| 6,512,631 | B2 | 1/2003 | Shafer et al. | |
| 7,679,731 | B2 | 3/2010 | Tezuka | |
| 7,705,331 | B1 * | 4/2010 | Kirk et al. | 250/493.1 |
| 7,786,455 | B2 | 8/2010 | Smith | |
| 2002/0154297 | A1 * | 10/2002 | Noguchi et al. | 356/237.3 |
| 2004/0165177 | A1 | 8/2004 | Katz et al. | |
| 2007/0182958 | A1 | 8/2007 | Manabe et al. | |
| 2007/0228288 | A1 | 10/2007 | Smith | |
| 2007/0273945 | A1 | 11/2007 | Furman et al. | |
| 2008/0017801 | A1 | 1/2008 | Fomenkov et al. | |
| 2008/0203883 | A1 * | 8/2008 | Takada et al. | 313/153 |
| 2008/0225245 | A1 | 9/2008 | Wood et al. | |
| 2009/0032740 | A1 | 2/2009 | Smith et al. | |
| 2010/0188486 | A1 | 7/2010 | Amanullah et al. | |
| 2011/0304681 | A1 * | 12/2011 | Okazaki | 347/224 |

FOREIGN PATENT DOCUMENTS

| | | | |
|---|---|---|---|
| JP | 2001-99630 | | 4/2001 |
| JP | 2008-263043 | A | 10/2008 |
| JP | 2008-268067 | A | 11/2008 |
| KR | 2008-0108111 | A | 12/2008 |
| KR | 2010-0083743 | A | 7/2010 |

* cited by examiner

*Primary Examiner* — Donald Raleigh
(74) *Attorney, Agent, or Firm* — Harness, Dickey & Pierce, PLC

(57) ABSTRACT

A broadband light illuminator of an optical inspector for optically detecting defects of an inspection object may include an electrode-less chamber including a plasma area from which broadband light is generated; a first energy provider, exterior to the chamber, configured to provide first energy for ionizing high pressure gases to form ionized gases in the chamber; a second energy provider, exterior to the chamber, configured to provide second energy for transforming the ionized gases into a plasma state to form the plasma area at a central portion of the chamber; an elliptical reflector having a first focus at which the chamber is positioned and a second focus such that the broadband light is reflected from the elliptical reflector toward the second focus; and a lens unit focusing the reflected broadband light onto the inspection object to form an inspection light for detecting the defects of the inspection object.

20 Claims, 6 Drawing Sheets

BROADBAND LIGHT ILLUMINATORS

CROSS-REFERENCE TO RELATED APPLICATION(S)

This application claims priority from Korean Patent Application No. 10-2011-0145437, filed on Dec. 29, 2011, in the Korean Intellectual Property Office (KIPO), the entire contents of which are incorporated herein by reference.

BACKGROUND

1. Field

Example embodiments may relate to broadband light illuminators and/or methods of illuminating broadband lights using the same. Example embodiments also may relate to broadband light illuminators of optical inspectors for inspecting defects of semiconductor devices and/or methods of illuminating the broadband lights onto wafers using the same.

2. Description of Related Art

Generally, minute defects of integrated circuit devices are detected by one of a bright-field optical inspector and a dark-field optical inspector in manufacturing semiconductor devices. The bright-field optical inspector usually uses a laser or a broadband light as a light source. For example, the broadband lights having some particular wavelengths are selected as the light source of the bright-field optical inspector, or the broadband light is incident onto the substrate at some particular incident angles in accordance with the operation modes of the optical inspector when operating the bright-field optical inspector. Otherwise, a polarized broadband light may also be used as the light source of the bright-field optical inspector. The broadband light for the bright-field optical inspector usually requires high optical intensity along every possible incident angles for accurate and rapid inspection process. Particularly, the inspection with respect to the fine and minute defects on a wafer needs to be conducted across various incident angles including 0° at high resolution, which requires higher optical intensity of the broadband light at every possible incident angles with respect to a surface of the wafer.

SUMMARY

Example embodiments may provide broadband light illuminators of optical inspectors for detecting defects with improved optical intensity and/or high optical efficiency.

Example embodiments also may provide methods of illuminating broadband light onto inspection objects using the broadband light illuminators.

In some example embodiments, a broadband light illuminator of an optical inspector for optically detecting defects of an inspection object may comprise an electrode-less chamber including a plasma area from which broadband light is generated; a first energy provider, at an exterior of the chamber, configured to provide first energy for ionizing high pressure gases in the chamber to form high pressure ionized gases in the chamber; a second energy provider, at the exterior of the chamber, configured to provide second energy for transforming the ionized gases into a plasma state to form the plasma area at a central portion of the chamber; an elliptical reflector having a first focus at which the chamber is positioned and a second focus such that the broadband light is reflected from the elliptical reflector toward the second focus; and/or a lens unit focusing the reflected broadband light onto the inspection object to form an inspection light for detecting the defects of the inspection object.

In some example embodiments, the chamber may comprise quartz.

In some example embodiments, the broadband light illuminator may further comprise a broadband light path changer configured to change paths of the reflected broadband light from the elliptical reflector to the lens unit in such a way that paths of parallel components of the broadband light travelling along a maximal cross-sectional surface of the reflector, including a major axis thereof, are changed at angles at the second focus by the broadband light path changer so that the parallel components of the broadband light, including an axial component traveling along the major axis, are incident onto the inspection object.

In some example embodiments, the parallel components of the broadband light may be incident on the lens unit at an incident angle of about 0° so that the inspection light is incident onto the inspection object at incident angles between about −70° and about +70°, including 0°.

In some example embodiments, a minimal optical intensity of the inspection light may be about 0.5 to about 0.6 times a maximal optical intensity of the inspection light across all of the incident angles of the inspection light.

In some example embodiments, the first and second focuses of the elliptical reflector may be configured so that a cross-sectional size of the broadband light, determined by a ratio of a second focusing distance with respect to a first focusing distance, is smaller than that of an incident surface of the lens unit. The first focusing distance may be a distance of the first focus from a surface of the elliptical reflector. The second focusing distance may be a distance of the second focus from the surface of the elliptical reflector along a major axis of the elliptical reflector.

In some example embodiments, a cross-sectional shape of the broadband light may be a circle having a diameter greater than or equal to about 1 mm and less than or equal to about 10 mm. The plasma area may be shaped as a sphere having a diameter greater than or equal to about 400 μm and less than or equal to about 500 μm.

In some example embodiments, the first energy provider may comprise an energy transfer unit configured to at least partially enclose the chamber and configured to move close to or away from the chamber, so that the first energy is uniformly transferred to the chamber; and/or a power supplier connected to the energy transfer unit and configured to supply the first energy to the energy transfer unit.

In some example embodiments, the first energy provider may comprise a first laser emitter configured to emit a first laser beam as a source of the first energy. The second energy provider may comprise a second laser emitter configured to emit a second laser beam as a source of the second energy.

In some example embodiments, the broadband light illuminator may further comprise a laser path changer configured to change paths of the first and second laser beams to the elliptical reflector from which the first and second laser beams are reflected to the chamber.

In some example embodiments, the lens unit may comprise a rod lens configured to transform the broadband light into a surface broadband light, and an objective lens configured to focus the surface broadband light onto the inspection object as the inspection light. The rod lens may have an incident surface of which a size is larger than a cross-sectional area of the broadband light, so that the broadband light is incident onto the incident surface of the rod lens without a substantial loss of intensity.

In some example embodiments, a method of illuminating broadband light to an inspection object in an optical inspector for optically detecting defects of the inspection object may comprise providing first energy to an electrode-less chamber from an exterior of the chamber, that is filled with seed materials for generating the broadband light, to form high pressure ionized gases from the seed materials in the chamber; providing second energy to the chamber from the exterior of the chamber, to form a plasma area at a central portion of the chamber from which the broadband light is generated; reflecting the broadband light emitted at a first focus toward a second focus using an elliptical reflector; and/or focusing the reflected broadband light that is reflected from the elliptical reflector onto the inspection object.

In some example embodiments, providing the first energy to the chamber may comprise moving an energy transfer unit close to the chamber such that the chamber is at least partially enclosed with the energy transfer unit; operating a power supplier connected to the energy transfer unit to generate the first energy from the power supplier; uniformly transferring the first energy to a whole surface of the chamber using the energy transfer unit; and/or moving the energy transfer unit away from the chamber such that no energy transfer unit is interposed between the elliptical reflector and the chamber.

In some example embodiments, providing the first energy to the chamber may comprise emitting a first laser beam from a first laser emitter; and/or guiding the first laser beam to the elliptical reflector, thereby reflecting the first laser beam into the chamber.

In some example embodiments, reflecting the broadband light using the elliptical reflector may comprise reflecting a cross-sectional portion of the broadband light, which travels along a maximal cross-sectional surface of the elliptical reflector, including a major axis thereof, toward the second focus such that the cross-sectional portion of the broadband light is incident onto a lens unit at an incident angle of about 0°.

In some example embodiments, a broadband light illuminator for optically detecting defects of an inspection object may comprise an elliptical reflector having first and second foci; a chamber, having no interior electrodes, at the first focus of the elliptical reflector; a first energy provider, exterior to the chamber, configured to provide first energy for forming ionized gases in the chamber; a second energy provider, exterior to the chamber, configured to provide second energy for transforming the ionized gases into a plasma state to generate broadband light in the chamber, wherein the broadband light is reflected from the elliptical reflector toward the second focus of the elliptical reflector; and/or a lens unit focusing the reflected broadband light onto the inspection object to form an inspection light for detecting the defects of the inspection object.

In some example embodiments, the first energy provider may comprise an energy transfer unit configured to at least partially enclose the chamber and configured to move close to or away from the chamber; and/or a power supplier configured to supply the first energy to the energy transfer unit.

In some example embodiments, the first energy provider may comprise a laser emitter configured to emit a laser beam as a source of the first energy.

In some example embodiments, the second energy provider may comprise a laser emitter configured to emit a laser beam as a source of the second energy.

In some example embodiments, the first energy provider may comprise a first laser emitter configured to emit a first laser beam as a source of the first energy. The second energy provider may comprise a second laser emitter configured to emit a second laser beam as a source of the second energy.

BRIEF DESCRIPTION OF THE DRAWINGS

The above and/or other aspects and advantages will become more apparent and more readily appreciated from the following detailed description of example embodiments, taken in conjunction with the accompanying drawings, in which.

DETAILED DESCRIPTION

Figure 1:
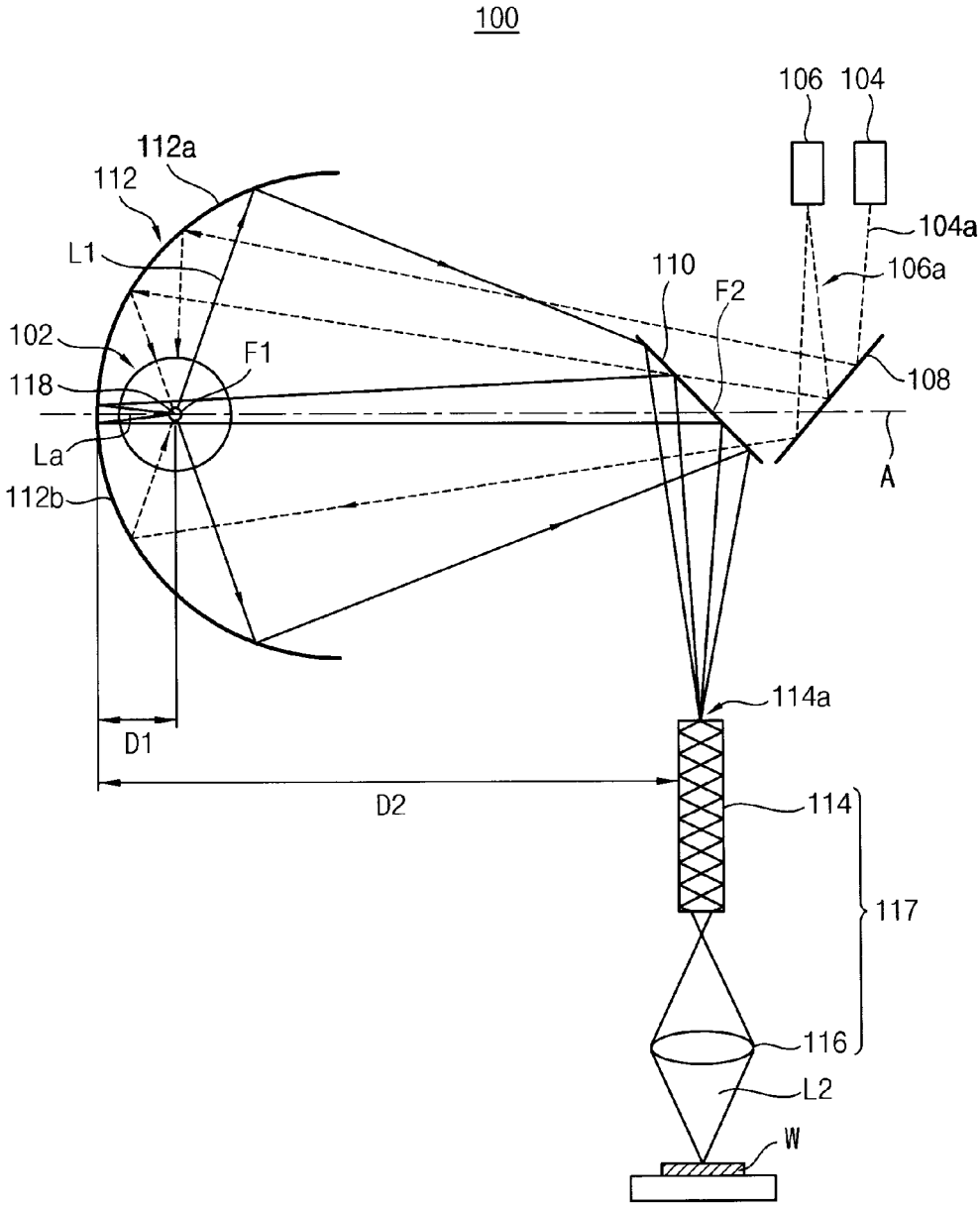
FIG. 1 is a structural view illustrating a broadband light illuminator in accordance with some example embodiments.

Example embodiments will now be described more fully with reference to the accompanying drawings. Embodiments, however, may be embodied in many different forms and should not be construed as being limited to the embodiments set forth herein. Rather, these example embodiments are provided so that this disclosure will be thorough and complete, and will fully convey the scope to those skilled in the art. In the drawings, the thicknesses of layers and regions may be exaggerated for clarity.

It will be understood that when an element is referred to as being "on," "connected to," "electrically connected to," or "coupled to" to another component, it may be directly on, connected to, electrically connected to, or coupled to the other component or intervening components may be present. In contrast, when a component is referred to as being "directly on," "directly connected to," "directly electrically connected to," or "directly coupled to" another component, there are no intervening components present. As used herein, the term "and/or" includes any and all combinations of one or more of the associated listed items.

It will be understood that although the terms first, second, third, etc., may be used herein to describe various elements, components, regions, layers, and/or sections, these elements, components, regions, layers, and/or sections should not be limited by these terms. These terms are only used to distinguish one element, component, region, layer, and/or section from another element, component, region, layer, and/or section. For example, a first element, component, region, layer, and/or section could be termed a second element, component, region, layer, and/or section without departing from the teachings of example embodiments.

Spatially relative terms, such as "beneath," "below," "lower," "above," "upper," and the like may be used herein for ease of description to describe the relationship of one component and/or feature to another component and/or feature, or other component(s) and/or feature(s), as illustrated in the drawings. It will be understood that the spatially relative terms are intended to encompass different orientations of the device in use or operation in addition to the orientation depicted in the figures.

The terminology used herein is for the purpose of describing particular example embodiments only and is not intended to be limiting of example embodiments. As used herein, the singular forms "a," "an," and "the" are intended to include the plural forms as well, unless the context clearly indicates otherwise. It will be further understood that the terms "comprises," "comprising," "includes," and/or "including," when used in this specification, specify the presence of stated features, integers, steps, operations, elements, and/or components, but do not preclude the presence or addition of one or more other features, integers, steps, operations, elements, components, and/or groups thereof.

Example embodiments may be described herein with reference to cross-sectional illustrations that are schematic illustrations of idealized example embodiments (and intermediate structures). As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. For example, an implanted region illustrated as a rectangle will typically have rounded or curved features and/or a gradient of implant concentration at its edges rather than a binary change from implanted to non-implanted region Likewise, a buried region formed by implantation may result in some implantation in the region between the buried region and the surface through which the implantation takes place. Thus, the regions illustrated in the figures are schematic in nature, their shapes are not intended to illustrate the actual shape of a region of a device, and their shapes are not intended to limit the scope of the example embodiments.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and should not be interpreted in an idealized or overly formal sense unless expressly so defined herein.

Reference will now be made to example embodiments, which are illustrated in the accompanying drawings, wherein like reference numerals may refer to like components throughout.

FIG. 1 is a structural view illustrating a broadband light illuminator in accordance with some example embodiments. In some example embodiments, the broadband light illuminator may be installed in an optical inspector for optically inspecting and detecting defects from an inspection object, such as a wafer.

Referring to FIG. 1, a broadband light illuminator 100 in accordance with some example embodiments may include an electrode-less chamber 102 including a plasma area 118 from which the broadband light L1 is generated and having no electrodes therein, a first energy provider positioned at an exterior of the chamber 102 and providing a first energy for ionizing high pressure gases in the chamber 102, to thereby form high pressure ionized gases in the chamber 102, a second energy provider positioned at the exterior of the chamber 102 and providing a second energy for transforming the ionized gases into a plasma state, to thereby form the plasma area 118 at a central portion of the chamber 102, an elliptical reflector 112 having a first focus F1 at which the chamber 102 is positioned and a second focus F2 such that the broadband light L1 is reflected from the elliptical reflector 112 toward the second focus F2, and a lens unit 117 focusing the reflected broadband light L1 onto an inspection object W, to thereby form an inspection light L2 for detecting the defects from the inspection object W.

The chamber 102 may be shaped into a sphere and may be filled with seed materials for generating the broadband light L1. The seed materials may be formed into ionized gases by the first energy and the ionized gases may be formed into plasma state by the second energy. For example, the chamber 102 may comprise quartz and may be sealed from surroundings. Particularly, no path-changeable elements such as electrodes may be provided in the chamber 102 and thus the path of the broadband light L1 generated from the chamber 102 may not be changed or absorbed in the chamber 102. For example, the chamber 102 may include an electrode-less lamp, and thus most of the broadband light L1 may be incident onto the inspection object W, such as a wafer, without light loss.

A pair of electrodes is provided in the chamber of the conventional broadband light illuminator and the electrodes in the chamber may function as an igniter to the inner gases of the chamber. Thus, the inner gases are ionized and transformed into a plasma state in the chamber by the energy transferred from the electrodes, and the broadband light is generated from the plasma in the chamber. However, the parallel components of the broadband light that travels in parallel with a maximal cross-sectional surface of the chamber on which the electrodes are arranged are partially absorbed into the electrodes and thus some of the parallel components are prevented from emitting outwards from the chamber. Thus, some of the broadband light cannot be incident onto the wafer and cannot be used as the inspection light. That is, some of the broadband light is lost when inspecting the wafer, to thereby decrease the optical efficiency of the illumination process. In addition, since some of the broadband light cannot reach the wafer, no broadband light is incident onto the wafer at a particular incident angle, and thus the deviation of the optical intensities is significantly large across the possible incident angles of the broadband light to the wafer. Consequently, the electrodes in the conventional chamber generally decrease the overall optical intensity of the inspection light and deteriorate the uniformity of the optical intensities across every incident angle of the broadband light.

In contrast, since no electrodes may be provided in the chamber 102 of the broadband light illuminator 100, the broadband light L1 generated in the chamber 102 may not be altered or absorbed in the chamber 102 and every component of the broadband light including the axial component La may be used as the inspection light L2 without any light loss. That is, most of the broadband light L1 may reach the inspection object W, such as the wafer, to thereby increase the overall optical intensity and uniformity of the optical intensities across all of the incident angles. For example, the seed materials for generating the broadband light L1 may include liquid or gaseous mercury (Hg) and xenon (Xe).

The first energy provider may be positioned at an exterior of the chamber 102 and provide a first energy for forming high pressure ionized gases in the chamber 102. For example, the first energy provider may include a first laser emitter 104 from which a first laser beam 104*a* may be emitted outwards as a source of the first energy. The first laser beam 104*a* may be uniformly incident onto a surface of the chamber 102 and thus the surface of the chamber 102 may be uniformly heated to such a degree that the seed materials may be uniformly ionized in the chamber 102. For example, the mercury gases may be initially filled into the chamber 102 and may be ionized to the ionized gases by the first energy. Otherwise, liquid mercury may be initially provided in the chamber 102 and then may be vaporized into a high pressure mercury gases in the chamber 102. Then, the first energy may be still provided into the chamber 102 to such a degree that the mercury gases may be sufficiently ionized in the chamber 102. In some example embodiments, the first laser beam 104*a* may be guided to the elliptical reflector 112 by a laser beam path changer 108 and may be reflected onto the chamber 102 by the elliptical reflector 112.

The second energy provider may be positioned at an exterior of the chamber 102 and provide a second energy for transforming the ionized gases into a plasma state to thereby form the plasma area 118 at a central portion of the chamber 102. For example, the second energy provider may include a second laser emitter 106 from which a second laser beam 106*a* may be emitted outwards as a source of the second energy. The second laser beam 106*a* may be focused into the chamber 102 and thus the high pressure ionized gases may be transformed into the plasma state the chamber 102. In some example embodiments, the second laser beam 106*a* may be emitted from the second laser emitter 106 and may be guided to the elliptical reflector 112 by the laser beam path changer 108. Then, the second laser beam 106*a* may be reflected into the chamber 102 by the elliptical reflector 112.

Particularly, the second laser beam 106*a* may be provided in such a manner that the ionized gases around a central portion of the chamber 102 may be transformed into the plasma state and thus the plasma area 118 may have a proper size at the central portion of the chamber 102.

The broadband light L1 may be generated from the plasma area 118 and may be emitted outwards out of the chamber 102. The second laser beam 106*a* may transfer electromagnetic energy to the high pressure ionized gases in the chamber 102 in such a way that the electromagnetic energy may be most optimally absorbed into the high pressure ionized gases. Particularly, the plasma area 118 may have a size as small as possible so as to increase the luminance of the broadband light L1. For example, the plasma area 118 may be shaped into a sphere having a diameter of about 400 μm to about 500 μm from which the broadband light L1 may be generated in such a way that a cross-sectional area of the broadband light L1 may have a size as small as possible. The small size of the cross-sectional area of the broadband light L1 may increase the possibility that most of the broadband light L1 may be incident onto an incidence surface of the lens unit 117 without any substantial loss of the broadband light L1, to thereby increase the optical efficiency of the broadband light L1 and the optical intensity of the inspection light L2.

While some example embodiments may disclose that the first and the second laser emitters 104 and 106 may be individually provided with the broadband light illuminator 100, a single laser emitter may also be used as the source of the first and second laser beams 104*a* and 106*a*. Thus, the first and second laser beams 104*a* and 106*a* may be emitted from the same laser emitter. In addition, the laser beam path changer 108 may also be used for guiding both of the first and second laser beams 104*a* and 106*a* to the elliptical reflector 112.

The elliptical reflector 112 may be shaped into a portion of an ellipse having the first focus F1 and the second focus F2 and having a major axis A extending through the first and the second focuses F1 and F2. Thus, the chamber 102 may be enclosed by the concave elliptical reflector 112. In some example embodiments, the chamber 102 may be positioned at the first focus F1 and thus the broadband light L1 emitted from the chamber 102 may be reflected from the elliptical reflector 112 toward the second focus F2.

In such a case, no electrodes may be arranged in the spherical chamber 102 and thus the broadband light L1 may be uniformly emitted towards all directions without any loss or absorptions caused by the electrodes. Therefore, most of the broadband light L1 may reach the elliptical reflector 112 without optical loss. Particularly, an axial component La of the broadband light L1 may be emitted from the chamber 102 along the major axis A of the ellipse, and thus may be reflected reversely to the second focus F2 along the same major axis A of the ellipse. Thus, the axial component La of the broadband light may also be reflected to the second focus F2 without optical loss such as the absorption by the chamber electrodes of the conventional broadband light illuminator, to thereby increase the optical intensity of the inspection light L2.

The lens unit 117 may be positioned at the second focus F2 and thus the reflected broadband light L1 reflected from the elliptical reflector 112 may be focused into the lens unit 117, and then the reflected broadband light L1 may be formed into the inspection light L2 by transmitting through the lens unit 117. Various defects on the inspection object W, such as the wafer, may be detected from the inspection object W by the inspection light L2.

Since the broadband light L1 emitting from the first focus F1 may be reflected toward the second focus F2, the cross-sectional area of the reflected broadband light L1 at the second focus F2 may be varied by the ratio of a second focal distance D2 with respect to a first focal distance D1 (referred to as focal distance ratio hereinafter). That is, the cross-sectional area of the reflected broadband light L1 at the second focus F2 may be varied by the ratio of the focal distance as well as the size of the plasma area 118. The first focal distance D1 denotes the distance between the elliptical reflector 112 and the first focus F1 along the major axis A and the second focal distance D2 denotes the distance between the elliptical reflector 112 and the second focus F2 along the major axis A.

In some example embodiments, the broadband light L1 may be controlled to have such a cross-sectional size that is smaller than the size of an incidence size of the lens unit 117 and thus the broadband light L1 may be incident onto the lens unit 117 without any optical loss, to thereby increase the optical efficiency of the broadband light L1 in the inspection process to the inspection object W. For example, the plasma area 118 may have the size of about 400 μm to about 500 μm and the broadband light L1 may have a circular cross-sectional area having a diameter of about 1 mm to about 10 mm. In addition, the first focal distance D1 may be in a range of about 30 mm to about 50 mm and the second focal distance D2 may be in a range of about 80 mm to about 100 mm.

In some example embodiments, the lens unit 117 may include a rod lens 114 for transforming the reflected broadband light L1 to a surface light and an objective lens 116 for focusing the surface light onto the inspection object W.

Since each component of the broadband light L1 may be reflected from the elliptical reflector 112 at different reflection angles according to the reflection point of the elliptical reflector 112 and may travel toward the second focus F2 at which the lens unit 117 may be positioned, the reflected broadband light L1 may be differently incident onto an incidence surface 114*a* the rod lens 114 and thus the optical density of the broadband light L1 may be different at the position of the incidence surface 114*a* of the rod lens 114. Then, the broadband light L1 may be totally reflected from the inner surface through the rod lens 114 and thus the broadband light L1 may be formed into the surface light when emitting the rod lens 114. The objective lens 116 may be positioned at a rear portion of the rod lens 114 and thus the surface light may be focused onto the inspection object W through the objective lens 116.

The size of the incidence surface 114*a* of the rod lens 114 may be determined by the magnification and the numerical aperture (NA) of the objective lens 116 and the broadband light L1 may be controlled to have the cross sectional size smaller than the size of the incidence surface of rod lens 114 by the ratio of the focal distance and the size of the plasma area 118. Thus, most of the broadband light L1 may be utilized as the inspection light L2 in the inspection process, to thereby minimize the optical loss of the broadband light L1 in the inspection process.

Particularly, the broadband light illuminator 100 may further include a broadband light path changer 110 for changing the path of the reflected broadband light to the lens unit 117.

For example, the broadband light path changer 110 may be arranged in such a configuration that the axial component La of the broadband light L1 may be directed toward the rod lens 114 perpendicularly to the major axis A at the second focus F2. Thus, any other components of the reflected broadband light L1 may be incident onto the incidence surface 114*a* of the rod lens 114 at some area around a central potion to which the axial component La of the broadband light L1 may be incident.

A cross-sectional portion of the broadband light L1, which may be emitted from the chamber in parallel with a maximal cross sectional surface of the chamber 102, may be reflected from the elliptical reflector 112 and be focused to the second focus F2 as a point light. Then, the point light may be incident onto the incidence surface 114*a* along a normal line thereof by the broadband light path changer 110. That is, the cross-sectional portion of the broadband light L1 may be incident onto the incidence surface 114*a* of the rod lens 114 at an angle of about 0° by the broadband light path changer 110.

A first portion of the broadband light L1, which may be emitted from the chamber across an upper hemisphere of the chamber 102, may be reflected from an upper portion 112*a* of the elliptical reflector 112 and may be incident onto the incidence surface 114*a* of the rod lens 114 at a left side of the normal line of the incidence surface 114*a* by the broadband light path changer 110. That is, the first portion of the broadband light L1 may be incident onto the incidence surface 114*a* in a range of (+) incidence angles by the broadband light path changer 110. In contrast, a second portion of the broadband light L1, which may be emitted from the chamber across a lower hemisphere of the chamber 102, may be reflected from a lower portion 112*b* of the elliptical reflector 112 and may be incident onto the incidence surface 114*a* of the rod lens 114 at a right side of the normal line of the incidence surface 114*a* by the broadband light path changer 110. That is, the second portion of the broadband light L1 may be incident onto the incidence surface 114*a* in a range of (−) incidence angles by the broadband light path changer 110.

Therefore, first and second portions of the broadband light L1 may be incident onto the incidence surface 114*a* symmetrically with respect to the normal line of the incidence surface 114*a* in a respective incidence angle range, which may be denoted as (+) angle and (−) angle, respectively, and the cross-sectional portion of the broadband light L1 may be incident onto the incidence surface 114*a* along the normal line thereof at an incidence angle of 0°. That is, the broadband light L1 may be incident onto the incidence surface 114*a* of the rod lens 114 at various incidence angles ranging from − value to + value including 0°. In such a case, the cross-sectional portion including the axial component La of the broadband light L1 may be sufficiently provided onto the incidence surface 114*a* without substantial optical loss and thus the deviation of the optical intensity between the cross-sectional portion and the first and second portions may be sufficiently decreased and may improve the uniformity of the optical intensity across the incidence surface 114*a* of the rod lens 114.

The optical characteristics of the broadband light L1 on the incidence surface 114*a* may have the same as those of the inspection light L2. That is, the reflected broadband light L1 may be transformed into the surface light without any changes of the optical characteristics by the rod lens 114 and the surface light may also be focused onto the inspection object W with the same optical characteristics. Thus, the optical characteristics of the reflected broadband light L1 may be the same as those of the inspection light L2. As a result, the inspection light L2 may be incident onto the inspection object W in a range of the inspection angle from some positive angles to some negative angles including 0° at which the inspection light L2 may be perpendicularly incident onto the inspection object W.

Accordingly, most of the cross-sectional portion of the broadband light L1 may be sufficiently incident onto the inspection object W without optical loss because any interrupts or absorbers such as electrodes for preventing the broadband light emission may not be arranged in the chamber 102, and thus the optical intensity of the inspection light L2 may be more uniform on the inspection object W across the range of the incidence angle from (−) values to (+) values including 0° and the average optical intensity of the inspection light L2 may be increased due to the increase of the intensity of the cross-sectional portion of the broadband light L1.

The range of the incidence angle of the inspection light L2 or the broadband light L1 may be varied in accordance with the ratio of the focal distance and the arrangement of the broadband light path changer 110. In some example embodiments, the incidence angle of the inspection light L2 may be in a range of about −70° to about +70°. In addition, the inspection light L2 may have a minimal intensity when the cross-sectional portion of the broadband light L1 may be incident onto the rod lens 114 along the normal line of the incidence surface 114*a* and have a maximal intensity when the first or the second portion of the broadband light L1 may be incident onto the rod lens 114 at a particular (−) angle or a (+) angle with respect to the normal line. In some example embodiments, the minimal intensity of the inspection light L2 may be about 0.5 to 0.6 times of the maximal intensity.

According to some example embodiments of the broadband light illuminator 100, the intensity deviation of the inspection light L2 may be sufficiently minimized on the inspection object W across all the possible incidence angles. Thus, the luminance of the inspection light L2 may be sufficiently uniform across the incidence angles and the average intensity of the inspection light L2 may be increased due to the increase of the optical intensity of the cross-sectional portion of the broadband light L1.

The broadband light illuminator 100 may be used for a light source for an optical inspector for detecting defects of semiconductor devices. Particularly, the cross-sectional portion of the broadband light may be sufficiently incident onto the lens unit 117 of the broadband light illuminator 100, unrevealed defects under the minute patterns may be more accurately detected by the optical inspector using the broadband light illuminator 100.

The conventional optical inspector using a conventional broadband light illuminator is performed at an inspection angle mode in which the inspection light is incident onto the inspection object at particular incidence angles or at a polarization mode in which a particular polarized light is used as the inspection light for the optical inspection process. However, when performing at the inspection angle mode, the optical inspector has to eliminate other portions of the broadband light except the broadband light corresponding to the particular incidence angles or the polarized light, which decreases the average intensity of the inspection light and thus decreases the efficiency and the accuracy of the inspection process. However, the broadband light illuminator 100 of some example embodiment may minimize the intensity deviation of the inspection light across the incidence angles and thus the intensity of the inspection light may not be decreased even when some of the broadband light may be eliminated or lost. As a result, the optical inspector including the broadband light illuminator 100 may be used in more various fields and the accuracy and efficiency of the inspection process may be sufficiently improved. Particularly, the optical inspector including the broadband light illuminator 100 may be used at various modes such as the incidence angle mode and the polarization mode with high efficiency and accuracy.

Figure 2:
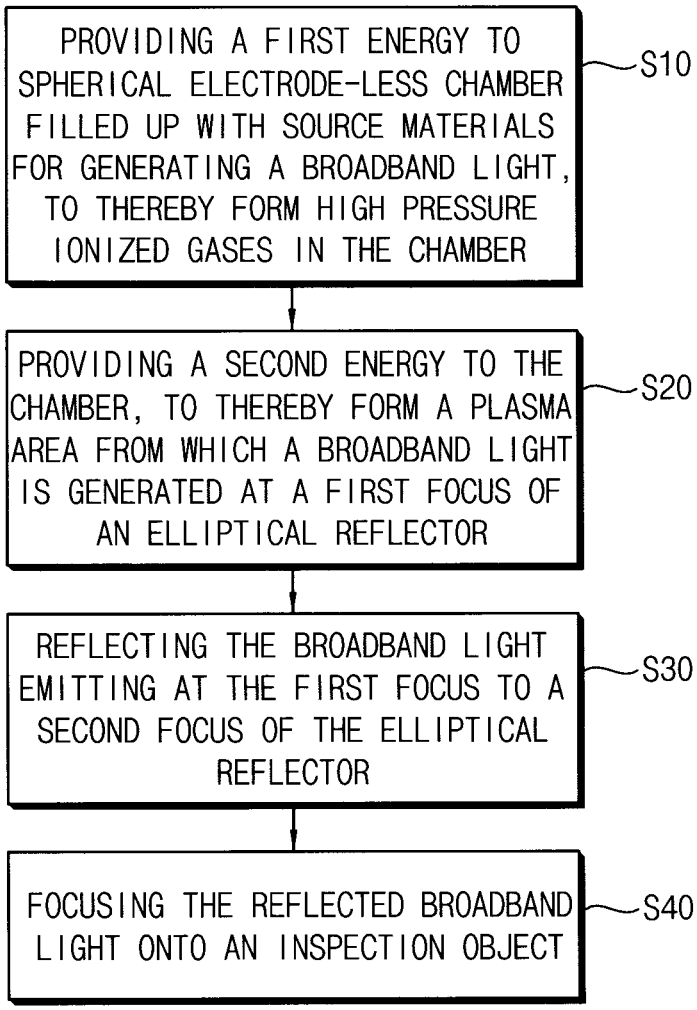
FIG. 2 is a flow chart showing processing steps for a method of illuminating the broadband light onto the inspection object using the broadband light illuminator illustrated in FIG. 1.

FIG. 2 is a flow chart showing processing steps for a method of illuminating the broadband light onto the inspection object using the broadband light illuminator 100 illustrated in FIG. 1. Hereinafter, the method of illuminating the broadband light L1 onto the inspection object will be described in detail with reference to FIGS. 1 and 2.

Referring to FIGS. 1 and 2, a first energy may be provided to a spherical electrode-less chamber that may be filled up with seed materials for generating a broadband light, to thereby form a high pressure ionized gases in the chamber (step S10).

For example, the seed materials for generating the broadband light L1 may be filled into the electrode-less chamber 102. The chamber 102 may be shaped into a sphere, to thereby facilitate the uniform emission of the broadband light in all directions. When completing the filling up of the seed materials into the chamber 102, the chamber 102 may be sealed off from surroundings. In some example embodiments, the chamber 102 may be formed into a quartz lamp filled up with the seed materials. The seed materials may include high pressure gases and a liquid such as mercury (Hg) and/or xenon (Xe). The mercury (Hg) may be filled into the chamber 102 as a liquid according to inspection conditions.

Then, the chamber 102 including the seed materials may be positioned on the first focus F1 of the broadband light illuminator 100 and the first energy may be provided to the spherical electrode-less chamber, to thereby form high pressure ionized gases in the chamber 102. In some example embodiments, the first energy may be provided to the chamber 102 from the exterior of the chamber 102 by the first laser emitter 104.

Figure 3:
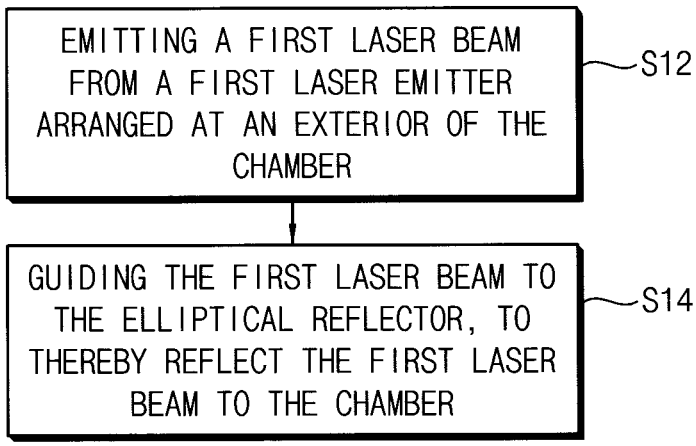
FIG. 3 is a flow chart showing the processing steps for providing the first energy using the first laser emitter shown in FIG. 1.

FIG. 3 is a flow chart showing the processing steps for providing the first energy using the first laser emitter shown in FIG. 1.

Referring to FIG. 3, the first laser beam 104*a* may be emitted from the first laser emitter 104 that may be arranged at an exterior of the chamber 102 (step S12) and may be guided to the elliptical reflector 112 (step S14). Then, the first laser beam 104*a* may be reflected to the chamber 102. For example, the first laser beam 104*a* may be guided to the elliptical reflector 112 by the laser beam path changer 108.

In some example embodiments, the first laser beam 104*a* may be reflected onto a surface of the chamber 102 and thus the first energy may be uniformly provided with the whole surface of the chamber 102. Therefore, the seed materials in the chamber 102 may be uniformly heated by the first energy and finally be ionized in the chamber 102. In case that the chamber 102 may be filled with liquid mercury, the first laser beam 104*a* may transfer the first energy to the chamber 102 in such a degree that the liquid mercury may be vaporized into mercury gases and the mercury gases may be sufficiently ionized into high pressure ionized gases. In contrast, in case that the chamber 102 may be filled with high pressure gases, the first laser beam 104*a* may transfer the first energy to the chamber 102 in such a degree that the high pressure gases may be sufficiently ionized into high pressure ionized gases.

Then, a second energy may be provided to the chamber 102 that may be filled with the high pressure ionized gases, to thereby form a plasma area 118 from which the broadband light L1 is generated (step S20). For example, the second laser beam 106*a* may be emitted from the second laser emitter 106 and may be guided to into a central portion of the chamber 102.

For example, the second laser beam 106*a* may be guided to the elliptical reflector 112 by the laser beam path changer 108 and may be reflected from the elliptical reflector 112 into the chamber 102. Thus, the second energy may be provided to the central portion of the chamber 102 and the high pressure ionized gases may be transformed into plasma state around the central portion of the chamber 102. That is, the plasma area 118 may be formed at the central portion of the chamber 102.

Since the plasma area 118 may be positioned at the central portion of the chamber 102, the broadband light L1 generated from the plasma area 118 may be uniformly emitted from the chamber 102 in all directions. Particularly, electrodes for providing energy to an inside of the chamber 102 may not be arranged in the chamber 102 and thus the broadband light L1 may be prevented from being absorbed or interrupted by the electrodes and thus may be prevented from being not emitted outwards from the chamber 102. The plasma area 118 may generate the broadband light L1 having high luminance and wide spectrum distribution such as an ultraviolet (UV) beam and a visible light on condition that mercury (Hg) and/or xenon (Xe) may be used as the seed materials. The smaller the size of the plasma area 118, the higher the luminance of the broadband light L1. Thus, the plasma area 118 may be formed into a small size as much as possible. In some example embodiments, the plasma area 118 may be formed into a sphere having a diameter of about 400 μm to about 500 μm.

Since the chamber 102 may be positioned at the first focus F1, the broadband light L1 may be emitted outwards at the first focus F1 and may reach the elliptical reflector 112.

Then, the broadband light L1 may be reflected from the elliptical reflector 112 toward the second focus F2 (step S30). Since the broadband light L1 may be emitted at the first focus F1 of the elliptical reflector 112, the broadband light reflected from the elliptical reflector 112 may be to be reflected to the second focus F2 of the elliptical reflector 112. That is, all the reflected broadband light L1 may be reflected toward the second focus F2 due to the geometric property of the ellipse.

Since no interrupts or absorbers for preventing the emission of the broadband light L1 may be arranged in the chamber 102, the broadband light L1 may be uniformly emitted from the chamber 102 in all directions. Particularly, the axial component La of the broadband light L1 may be emitted along the major axis A toward the elliptical reflector 112 and then may be reflected from the elliptical reflector 112 reversely along the major axis A toward the second focus F2. Thus, the cross-sectional portion of the broadband light L1 may be reflected from the reflector toward the second focus F2 without any substantial optical loss, to thereby increase the optical intensity of the cross-sectional portion of the broadband light L1 at the second focus F2 as compared with the conventional illuminator in which the axial component of the broadband light is absorbed into a pair of the electrodes that is positioned on the major axis of the elliptical reflector. In addition, the first portion of the broadband light L1, which may be emitted from an upper hemispherical portion of the chamber 102, may be reflected from the upper portion 112*a* of the elliptical reflector 112 toward the second focus F2 and the second portion of the broadband light L1, which may be emitted from a lower hemispherical portion of the chamber 102, may be reflected from the lower portion 112*b* of the elliptical reflector 112 toward the second focus F2.

Then, the reflected broadband light L1 including the cross-sectional portion, the first portion, and the second portion thereof may be focused onto the inspection object W (step S40), to thereby form the inspection light L2 for detecting the defects from the inspection object W.

The reflected broadband light L1 reflected from the elliptical reflector 112 toward the second focus F2 may be focused onto the inspection object W by the lens unit 117 including the rod lens 114 and the objective lens 116. The reflected broadband light L1 may be formed into a surface light by the rod lens 114 and the surface light may be focused onto the inspection object W. Further, the reflected broadband light L1 may be guided to an arbitrary direction by the broadband light path changer 110 and thus the inspection object W may be located at an arbitrary position irrespective of the second focus F2.

In some example embodiments, the broadband light path changer 110 may be arranged in such a configuration that the path of the axial component La of the broadband light L1 may be changed at an angle of about 90° toward the incidence surface 114*a* of the rod lens 114 by the broadband light path changer 110. That is, the axial component La of the broadband light L1 may be incident onto the incidence surface 114*a* along a normal line or a perpendicular line of the incidence surface 114*a*. As a result, the first portion of the broadband light L1 may be incident onto a first portion of the incidence surface 114*a* in a range of some incidence angles and the second portion of the broadband light L1 may be incident onto a second portion of the incidence surface 114*a* in a range of some incidence angles. The first and the second portions of the incidence surface 114*a* may be symmetric with respect to a normal surface including the normal line. The incidence angle may be varied in accordance with the reflection position of the elliptical reflector 112, the focal distance ratio, and structures and arranges of the broadband light path changer 110. Accordingly, the broadband light L1 may be incident onto the incidence surface 114*a* of the rod lens 114 in a range of the incidence angles symmetrical to the normal surface of the incidence surface 114*a* including the normal line.

Therefore, the cross-sectional portion of the broadband light L1 may be incident onto the incidence surface 114*a* along the normal line and may have a minimal intensity around the incidence angle of about 0° on the incidence surface 114*a*. In contrast, the first and the second portions of the broadband light L1 may be incident onto the first and the second portions of the incidence surface 114*a*, respectively, and may have a maximal intensity at a respective particular incidence angle.

The broadband light L1 may be totally reflected from an inner surface of the rod lens 114 and thus may be transformed into the surface light at an exit surface of the rod lens 114. Then, the surface light may be incident onto the objective lens 116 without any changes of optical characteristics of the broadband light L1 on the incidence surface 114*a* of the rod lens 114. Thus, the surface light may be incident onto the inspection object W through the objective lens 116 with the same optical characteristics as the broadband light L1 on the incidence surface 114*a*, to thereby form the inspection light L2 for inspecting the defects of the inspection object W.

As a result, the inspection light L2 may be incident onto the inspection object W in a range of incidence angles as well as in a normal line of the inspection object W at an incidence angle of about 0°. Thus, the inspection light L2 may have a minimal intensity when the inspection light L2 may be incident onto the inspection object W at an incidence angle of about 0° and may have a maximal intensity when the inspection light L2 may be incident onto the inspection object W at particular incidence angles symmetrical to a normal surface including the normal line of the inspection object W. In some example embodiments, the minimal intensity of the inspection light L2 may be about 0.5 to 0.6 times the maximal intensity.

Particularly, a vertical portion of the inspection light L2, which may be incident onto the inspection object W along the normal line thereof at the incident angle of about 0°, may be very effective for detecting the defects right under a surface of the inspection object W. For example, when inspecting minute patterns on the inspection object W, the defects right under the minute patterns may be much more efficiently detected just by the vertical portion of the inspection light L2 than by an inclined portion of the inspection light L2, which may be incident onto the inspection object W with being inclined from the normal line as much as the incident angle. Thus, the more the intensity of the vertical portion of the inspection light L2, the higher the detection efficiency of the defects under the minute patterns. In addition, the intensity deviation between the vertical portion and the inclined portion of the inspection light L2 may be sufficiently reduced due to the increase of the optical intensity of the vertical portion, to thereby improve the uniformity of the inspection light L2. Further, the average intensity of the inspection light L2 may be sufficiently increased due to the increase of the optical intensity of the vertical portion, to thereby increase the inspection speed and accuracy. That is, the optical intensity of the vertical portion of the inspection light L2 may be sufficiently increased due to the removal of the electrodes from the chamber 102, which may reduce the intensity deviation between the vertical portion and the inclined portion of the inspection light L2 and thus may improve the luminance of the inspection light L2.

Figure 4:
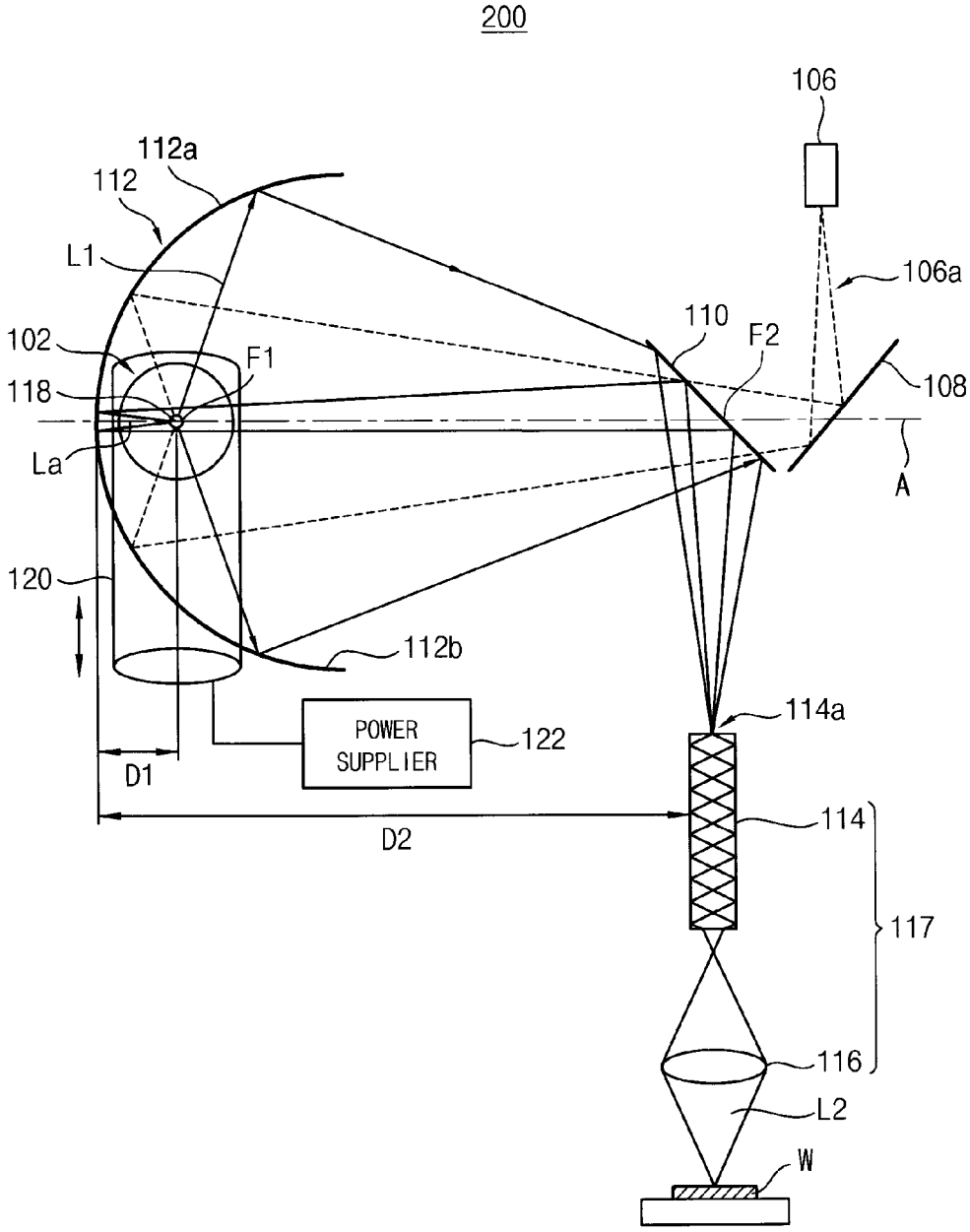
FIG. 4 is a structural view illustrating a broadband light illuminator in accordance with some example embodiments.

FIG. 4 is a structural view illustrating a broadband light illuminator 200 in accordance with some example embodiments. The broadband light illuminator 200 in FIG. 4 may have substantially the same structure as the broadband light illuminator 100 shown in FIG. 1, except for the first energy provider for forming high pressure ionized gases in the chamber. In FIG. 4, the same reference numerals denote the same or like elements in FIG. 1 and the same or like elements work the same or like function as described with reference to FIG. 1. Thus, any further detailed descriptions on the same elements will be omitted hereinafter.

Referring to FIG. 4, the broadband light illuminator 200 in accordance with some example embodiments may include an energy transfer unit 120 for transferring a first energy to the chamber 102 and a power supplier 122 for generating the first energy as the first energy provider. The seed materials in the chamber 102 may be ionized into ionized gases by the first energy and the ionized gases may be formed into plasma state by the second energy in the chamber 102.

The energy transfer unit 120 may be arranged at an exterior of the chamber 102 in such a configuration that the chamber 102 may be enclosed by the energy transfer unit 120, and thus the first energy may be uniformly transformed to the chamber 102. In some example embodiments, the energy transfer unit 120 may be shaped into a cylindrical cap including the chamber 102 therein, and thus the chamber 102 may be fully enclosed by the cylindrical cap-shaped energy transfer unit 120. Thus, the first energy may be uniformly transferred to a whole surface of the chamber 102.

In such a case, the elliptical reflector 112 may include a penetration hole (not shown) through which the energy transfer unit 120 may move close to or away from the chamber 102. For example, the penetration hole may be shaped into a ring having the same size of the energy transfer unit 120.

In case that the energy transfer unit 120 may still enclose the chamber 102 at the time when the second energy for transforming the ionized gases into plasma state may be transferred to the chamber 102, the second energy may be transferred to the chamber 102 with poor efficiency and the broadband light L1 emitting from the chamber 102 may be interrupted from reaching the elliptical reflector 112. As a result, the optical intensity of the broadband light L1 may be insufficient on the incidence surface 114*a* of the rod lens 114. For those reasons, the energy transfer unit 120 may be controlled to move away from the chamber 102 before the step of providing the second energy to the chamber 102. That is, the energy transfer unit 120 may be controlled to move close to the chamber 102 through the penetration hole of the elliptical reflector 112 just when providing the first energy to the chamber 102 for ionizing the seed materials and to move away from the chamber 102 through the penetration hole of the elliptical reflector 112 before providing the second energy to the chamber 102 for transforming the ionized gases into plasma state. Thus, when the second energy may be provided to the chamber 102, the energy transfer unit 120 may be positioned at the exterior of the elliptical reflector 112.

Since the energy transfer unit 120 may enclose the chamber 102, the first energy may be uniformly transferred to the chamber 102 and thus the seed materials in the chamber 102 may be ionized into the high pressure ionized gases. In case that a liquid material may be initially filled up in the chamber 102 as the seed material, the first energy may be provided into the chamber 102 sufficiently to vaporize the liquid material and to ionize the vaporized material.

The power supplier 122 may generate the first energy and supply the first energy to the energy transfer unit 120. For example, the first energy may be generated as high frequency wave such as a radio frequency (RF) wave and a microwave. The power supplier 122 may be mounted on the energy transfer unit 120 or may be formed into the energy transfer unit 120 together with each other in one body. Otherwise, the power supplier 122 may be additionally arranged out of the energy transfer unit 120 and may be connected to the energy transfer unit 120.

The seed materials in the chamber 102 may be formed into the ionized gases by the first energy and the ionized gases may be formed into the plasma state by the second energy, to thereby form the plasma area 118 from which the broadband light L1 may be emitted. The elliptical reflector 112 for reflecting the broadband light L1 toward the second focus F2, the broadband light path changer 110 for changing the path of the broadband light L1 to the inspection object W and the lens unit 117 for focusing the broadband light L1 to the inspection object W may have the same structures and configurations as described above with reference to FIG. 1, and thus any detailed descriptions on the elliptical reflector 112, broadband light path changer 110 and the lens unit 117 may be omitted.

According to the above-described broadband light illuminator 200, the energy transfer unit 120 may be controlled to move close to the chamber 102 and then the first energy may be uniformly transferred to the chamber 102, to thereby form the ionized gases in the chamber 102. Thereafter, the energy transfer unit 120 may be controlled to move away from the chamber 102 before the second energy may be provided to the chamber 102. Thus, the first energy may be efficiently transferred to the chamber 102 without deteriorating energy efficiency of the second energy for forming the plasma area 118.

Hereinafter, illumination method using the above broadband light illuminator 200 will be described in detail with reference to FIG. 5. The method of illuminating the broadband light using the above broadband light illuminator 200 in FIG. 4 may be the same as the method described with reference to FIG. 2, except the step for forming the ionized gases in the chamber. Thus, the present illumination method using the above broadband light illuminator 200 will be described around the step of providing the first energy for forming the high pressure ionized gases and any detailed descriptions on the other steps will be omitted.

Figure 5:
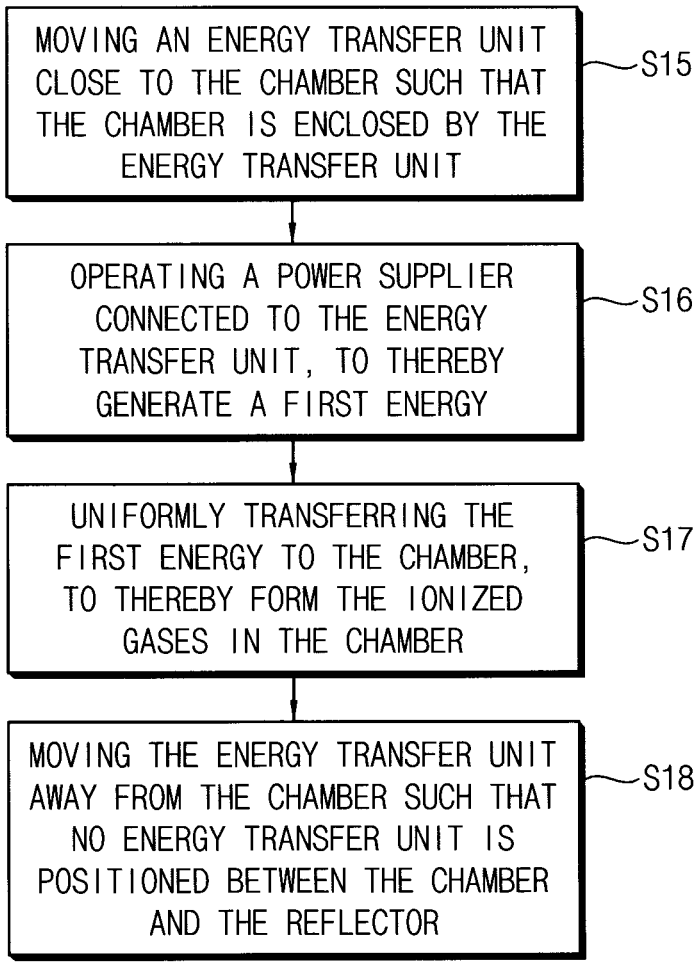
FIG. 5 is a flow chart showing the processing steps for providing the first energy using the energy transfer unit and the power supplier shown in FIG. 4.

FIG. 5 is a flow chart showing the processing steps for providing the first energy using the energy transfer unit and the power supplier shown in FIG. 4.

Referring to FIGS. 2, 4 and 5, the energy transfer unit 120 may be controlled to move close to the chamber 102 in such a configuration that the chamber 102 may be enclosed by the energy transfer unit 120 (step S15). For example, the energy transfer unit 120 may be arranged at the exterior of the elliptical reflector 112 and may move close to the chamber 102 through the penetration hole of the elliptical reflector 112. The energy transfer unit 120 may be shaped into a cylindrical cap and the chamber 102 may be positioned in the cylindrical cap. Thus, an outer surface of the chamber 102 may be wholly enclosed by the cylindrical cap.

Then, the power suppler 122 that may be connected to the energy transfer unit 120 may be operated, thereby generating the first energy (step S16). For example, a high frequency wave such as a radio frequency wave and a microwave may be generated from the power supplier 122.

Then, the first energy may be uniformly transferred to the chamber 102 and thus the seed materials in the chamber 102 may be uniformly ionized into the high pressure ionized gases (step S17), Since the chamber 102 may be enclosed by the energy transfer unit 120, the first energy may be uniformly transferred to the outer surface of the chamber 102, and thus the chamber 102 may be uniformly heated in all directions. Therefore, the seed materials in the chamber 102 may be uniformly heated and thus may be uniformly ionized in the chamber 102.

The first energy may be provided to the chamber 102 sufficiently to ionize the seed materials in the chamber 102. When the chamber 102 may be filled with sufficient the high pressure ionized gases, the power supplier 122 may stop generating the first energy and the energy transfer unit 120 may be controlled to move away from the chamber 102 through the penetration hole (step S18). Thus, the energy transfer unit 120 may not positioned between the chamber 102 and the elliptical reflector 112 when the chamber 102 may be sufficiently filled with the high pressure ionized gases and may be ready for the step for forming the plasma area 118 by the second energy. As a result, the second laser beam 106*a* may be efficiently reach the chamber 102 and the broadband light L1 may reach the elliptical reflector 112 with high efficiency.

While some example embodiments may disclose that the power supplier and the energy transfer unit are used for providing just the first energy to the chamber, the second energy may also be transferred to the chamber by the power supplier and the energy transfer unit as long as the power supplier and the energy transfer unit may provide energy sufficiently for transforming the ionized gases into plasma state.

Further, while some example embodiments may disclose that the energy transfer unit arranged at the exterior of the reflector may move close to or away from the chamber through the penetration hole of the reflector, the energy transfer unit may also move close to or away from the chamber through an opening of the reflector directing the second focus. In such a case, no penetration hole may be needed at the reflector.

Thereafter, in the same way as described with reference to FIG. 2, the second energy may be provided to the chamber 102 and the plasma area 118 from which the broadband light L1 may be emitted may be formed in the chamber 102. The broadband light L1 may be reflected from the elliptical reflector 112 toward the second focus F2 and the reflected broadband light L1 may be focused onto the inspection object W as the inspection light L2 for detecting defects from the inspection object W.

According to the illumination method of the broadband light, the energy transfer unit may move close to the chamber and then the first energy may be uniformly transferred to the chamber with high efficiency. Then, the energy transfer unit may move away from the chamber and out of the reflector before providing the second energy to the chamber, and thus the second energy may be efficiently transferred to the chamber and the broadband light L1 may be sufficiently reach the reflector.

Since the first energy, such as an RF power and/or a microwave, may be provided to the chamber at the outside of the chamber and the seed materials may be sufficiently formed into the high pressure ionized gases in the chamber by the first energy, no internal electrodes for providing energy for forming the high pressure ionized gases may be needed and thus the cross-sectional portion of the broadband light L1 may be sufficiently incident onto the lens unit without any optical loss.

Comparative Experiment

The optical intensity of the inspection light was measured on a wafer at some possible incidence angles, respectively, using the conventional laser-produced plasma (LPP) broadband light illuminator in which a pair of electrodes was arranged in the lamp. The conventional broadband light was emitted from the electrode-in lamp. The electrodes may be spaced apart from each other by a gap distance of about 3 mm and a power of about 1 kW was applied to the internal electrodes so as to generate energy for ionizing the seed materials in the lamp. Under the same elliptical reflector and lens conditions, the optical intensity of the inspection light was measured on the wafer at the same incidence angles, respectively, using the present LPP broadband light illuminator in which no electrode was arranged in the lamp. The broadband light was emitted from the electrode-less lamp in which the plasma area was formed into a sphere having a diameter of about 400 μm. The elliptical reflector was configured to have the first focus of about 50 mm and the second focus of about 300 mm. In addition, the incidence surface of the rod lens may be configured to have a square area of about 10 mm.

Figure 6:
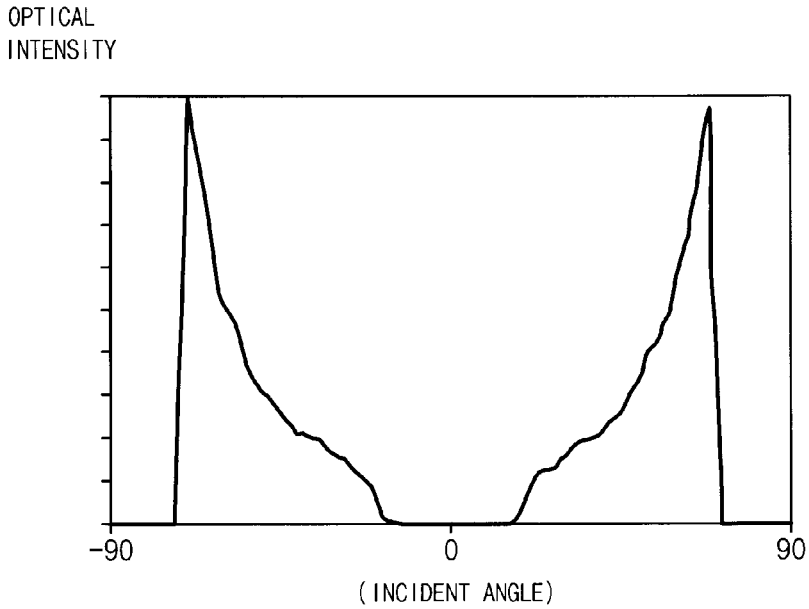
FIG. 6 (CONVENTIONAL ART)
FIG. 6 is a graph showing the relations between optical intensity of a broadband light and respective incidence angles of the broadband light on a wafer using a conventional broadband light illuminator.
Figure 7:
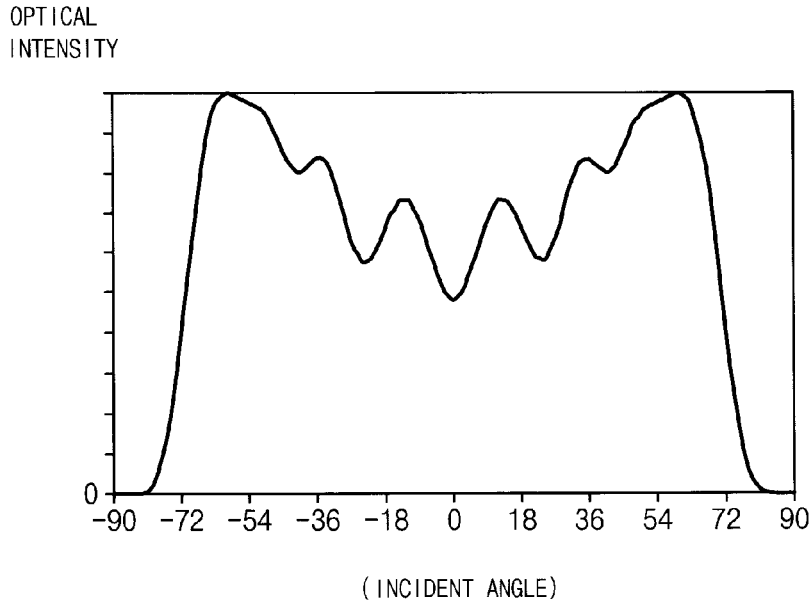
FIG. 7 is a graph showing the relations between optical intensity of a broadband light and respective incidence angles of the broadband light on a wafer using a broadband light illuminator shown in FIG. 1.

FIG. 6 is a graph showing the relations between optical intensity of a broadband light and respective incidence angles of the broadband light on a wafer using a conventional broadband light illuminator, and FIG. 7 is a graph showing the relations between optical intensity of a broadband light and respective incidence angles of the broadband light on a wafer using a broadband light illuminator shown in FIG. 1.

Referring to FIG. 6, the inspection light was incident onto the wafer at an incidence angle of about 0° and the optical intensity of the inspection light ranged from about +30° to −30° was about 10% or less of the maximal optical intensity. The cross-sectional portion of the conventional broadband light was prevented from emitting from the lamp due to the electrodes, and thus the optical intensity of the inspection light on the wafer was ignorable in a range of the incidence angles of about −30° to +30°, including 0°. According to the conventional broadband light illuminator, the optical intensity of the inspection light was sufficient at some particular incidence angles and was very insufficient around the rest of the incidence angles. Thus, the intensity deviation was quite large across the possible incidence angles.

Therefore, when inspecting the wafer using the conventional broadband light illuminator, the optical intensity of the inspection light was insufficient on the wafer, more particularly, at the inspection angle mode and the polarization mode of the illuminator. For that reason, the conventional broadband light illuminator was difficult to work with sufficient optical intensity regardless the operation mode thereof.

In contrast, referring to FIG. 7, the inspection light was incident onto the wafer at an incidence angle of about 0° with a relatively high intensity; the optical intensity of the broadband light ranged from about +30° to −30° was about 50% or more of the maximal optical intensity. The cross-sectional portion of the conventional broadband light was sufficiently emitted from the lamp since no electrode was provided in the lamp, and thus the optical intensity of the inspection light on the wafer was relatively sufficient in a range of the incidence angles of about −30° to +30°, including 0°. According to the broadband light illuminator of some example embodiments, the optical intensity of the inspection light was sufficient and uniform across the incidence angles and the average intensity of the inspection light was considerably increased as compared with the conventional illuminator. Thus, the intensity deviation was also improved across the possible incidence angles.

Therefore, when inspecting the wafer using the broadband light illuminator of some example embodiments, the optical intensity of the inspection light was sufficient on the wafer at the inspection angle mode and the polarization mode of the illuminator. For that reason, the broadband light illuminator was operated with sufficient optical intensity regardless the operation mode thereof.

According to some example embodiments, the cross-sectional portion of the broadband light emitting from the chamber may be sufficiently incident onto the inspection object as well as the first and the second portions of the broadband light because no electrodes may be arranged in the chamber. Thus, the vertical portion of the inspection light, which may incident onto the inspection object at an angle of about 0°, may also have a sufficient optical intensity and thus the intensity deviation of the inspection light may be decreased on the wafer across possible incidence angles. Therefore, the broadband light illuminator may be used at various illumination modes irrespective of the optical intensity. Particularly, the sufficient intensity of the vertical portion of the inspection light may facilitate the accurate detection of the defects under the minute patterns on the wafer.

The broadband light illuminator may be installed to an optical inspector for optically detecting defects from the inspection object, such as a wafer. Particularly, the broadband light illuminator may be installed to a bright-field optical inspector for detecting the defects from minute patterns having a width of about a few tens of nanometers.

While example embodiments have been particularly shown and described, it will be understood by those of ordinary skill in the art that various changes in form and details may be made therein without departing from the spirit and scope of the present invention as defined by the following claims.

What is claimed is:

1. A broadband light illuminator of an optical inspector for optically detecting defects of an inspection object, the broadband light illuminator comprising:

an electrode-less chamber including a plasma area from which broadband light is generated;

a first energy provider, at an exterior of the chamber, configured to provide first energy for ionizing gases in the chamber to form ionized gases in the chamber;

a second energy provider, at the exterior of the chamber, configured to provide second energy to the ionized gases to form the plasma area at a central portion of the chamber;

an elliptical reflector having a first focus at which the chamber is positioned and a second focus such that the broadband light is reflected from the elliptical reflector toward the second focus; and a lens unit focusing the reflected broadband light onto the inspection object to form an inspection light for detecting the defects of the inspection object;

wherein the chamber is between the elliptical reflector and the second focus.

2. The broadband light illuminator of claim 1, wherein the chamber comprises quartz.

3. The broadband light illuminator of claim 1, further comprising:

a broadband light path changer configured to change paths of the reflected broadband light from the elliptical reflector to the lens unit in such a way that paths of parallel components of the broadband light travelling along a maximal cross-sectional surface of the elliptical reflector, including a major axis thereof, are changed at angles at the second focus by the broadband light path changer so that the parallel components of the broadband light, including an axial component traveling along the major axis, are incident onto the inspection object.

4. The broadband light illuminator of claim 3, wherein the parallel components of the broadband light are incident on the lens unit at an incident angle of about 0° so that the inspection light is incident onto the inspection object at incident angles between about −70° and about +70°, including 0°.

5. The broadband light illuminator of claim 4, wherein a minimal optical intensity of the inspection light is about 0.5 to about 0.6 times a maximal optical intensity of the inspection light across all of the incident angles of the inspection light.

6. A broadband light illuminator of an optical inspector for optically detecting defects of an inspection object, the broadband light illuminator comprising:

an electrode-less chamber including a plasma area from which broadband light is generated;

a first energy provider, at an exterior of the chamber, configured to provide first energy for ionizing high pressure gases in the chamber to form high pressure ionized gases in the chamber;

a second energy provider, at the exterior of the chamber, configured to provide second energy for transforming the ionized gases into a plasma state to form the plasma area at a central portion of the chamber;

an elliptical reflector having a first focus at which the chamber is positioned and a second focus such that the broadband light is reflected from the elliptical reflector toward the second focus; and a lens unit focusing the reflected broadband light onto the inspection object to form an inspection light for detecting the defects of the inspection object;

wherein the first and second foci of the elliptical reflector are configured so that a cross-sectional size of the broadband light, determined by a ratio of a second focusing distance with respect to a first focusing distance, is smaller than that of an incident surface of the lens unit, wherein the first focusing distance is a distance of the first focus from a surface of the elliptical reflector, and wherein the second focusing distance is a distance of the second focus from the surface of the elliptical reflector along a major axis of the elliptical reflector.

7. The broadband light illuminator of claim 6, wherein a cross-sectional shape of the broadband light is a circle having a diameter greater than or equal to about 1 mm and less than or equal to about 10 mm, and wherein the plasma area is shaped as a sphere having a diameter greater than or equal to about 400 μm and less than or equal to about 500 μm.

8. The broadband light illuminator of claim 1, wherein the first energy provider comprises:

an energy transfer unit configured to at least partially enclose the chamber and configured to move close to or away from the chamber, so that the first energy is uniformly transferred to the chamber; and a power supplier connected to the energy transfer unit and configured to supply the first energy to the energy transfer unit.

9. The broadband light illuminator of claim 1, wherein the first energy provider comprises a first laser emitter configured to emit a first laser beam as a source of the first energy, and wherein the second energy provider comprises a second laser emitter configured to emit a second laser beam as a source of the second energy.

10. The broadband light illuminator of claim 9, further comprising:

a laser path changer configured to change paths of the first and second laser beams to the elliptical reflector from which the first and second laser beams are reflected to the chamber.

11. The broadband light illuminator of claim 1, wherein the lens unit comprises a rod lens configured to transform the broadband light into a surface broadband light, and an objective lens configured to focus the surface broadband light onto the inspection object as the inspection light, and wherein the rod lens has an incident surface of which a size is larger than a cross-sectional area of the broadband light, so that the broadband light is incident onto the incident surface of the rod lens without a substantial loss of intensity.

12. A broadband light illuminator for optically detecting defects of an inspection object, the broadband light illuminator comprising:

an elliptical reflector having first and second foci;

a chamber, having no interior electrodes, at the first focus of the elliptical reflector;

a first energy provider, exterior to the chamber, configured to provide first energy for forming ionized gases in the chamber;

a second energy provider, exterior to the chamber, configured to provide second energy to the ionized gases to generate broadband light in the chamber, wherein the broadband light is reflected from the elliptical reflector toward the second focus of the elliptical reflector; and a lens unit focusing the reflected broadband light onto the inspection object to form an inspection light for detecting the defects of the inspection object;

wherein the chamber is between the elliptical reflector and the second focus.

13. The broadband light illuminator of claim 12, wherein the first energy provider comprises:

an energy transfer unit configured to at least partially enclose the chamber and configured to move close to or away from the chamber; and a power supplier configured to supply the first energy to the energy transfer unit.

14. The broadband light illuminator of claim 12, wherein the first energy provider comprises a laser emitter configured to emit a laser beam as a source of the first energy.

15. The broadband light illuminator of claim 12, wherein the second energy provider comprises a laser emitter configured to emit a laser beam as a source of the second energy.

16. The broadband light illuminator of claim 12, wherein the first energy provider comprises a first laser emitter configured to emit a first laser beam as a source of the first energy, and wherein the second energy provider comprises a second laser emitter configured to emit a second laser beam as a source of the second energy.

17. The broadband light illuminator of claim 1, wherein the first energy provider comprises a laser emitter configured to emit a laser beam as a source of the first energy.

18. The broadband light illuminator of claim 17, wherein the elliptical reflector is configured to reflect the laser beam to the chamber.

19. The broadband light illuminator of claim 1, wherein the second energy provider comprises a laser emitter configured to emit a laser beam as a source of the second energy.

20. The broadband light illuminator of claim 19, wherein the elliptical reflector is configured to reflect the laser beam to the chamber.

* * * * *